US008011731B2

(12) United States Patent
Goddu

(10) Patent No.: US 8,011,731 B2
(45) Date of Patent: Sep. 6, 2011

(54) COLLAPSIBLE TABLETOP HEAD CRADLE FOR SEATED USERS

(76) Inventor: Thomas James Goddu, Pine Meadow, CT (US)

( * ) Notice: Subject to any disclaimer, the term of this patent is extended or adjusted under 35 U.S.C. 154(b) by 306 days.

(21) Appl. No.: 12/387,338

(22) Filed: May 1, 2009

(65) Prior Publication Data

US 2009/0302659 A1 Dec. 10, 2009

Related U.S. Application Data

(60) Provisional application No. 61/059,215, filed on Jun. 5, 2008.

(51) Int. Cl.
*A47C 1/10* (2006.01)

(52) U.S. Cl. ..... 297/397; 297/393; 297/392

(58) Field of Classification Search ..... 297/392, 297/399, 398, 391, 393, 397; 5/640, 603, 5/622, 637

See application file for complete search history.

(56) References Cited

U.S. PATENT DOCUMENTS 3,066,980 A * 12/1962 Clute ..... 297/252
3,315,282 A 4/1967 Lowery et al.
4,097,038 A * 6/1978 Jansen ..... 5/637
4,235,472 A 11/1980 Sparks et al.
4,565,408 A * 1/1986 Palley ..... 297/393
4,710,991 A * 12/1987 Wilmore et al. ..... 5/637
5,505,523 A * 4/1996 Wang ..... 297/393
5,645,319 A * 7/1997 Parks, Jr. ..... 297/391
5,675,851 A 10/1997 Feathers
6,042,185 A * 3/2000 Cowgur ..... 297/393
6,151,734 A * 11/2000 Lawrie ..... 5/640
6,374,441 B1 4/2002 Begell
6,412,127 B1 7/2002 Cuddy
6,427,273 B1 8/2002 Berke et al.
6,647,573 B2 11/2003 Corbin
6,721,978 B1 4/2004 Tankersley
6,758,526 B2 * 7/2004 Marbutt ..... 297/397
7,640,649 B2 * 1/2010 Fukaya et al. ..... 29/603.02
7,788,751 B1 * 9/2010 Diemer et al. ..... 5/644
7,909,406 B2 * 3/2011 Samuelsen ..... 297/397
2004/0026979 A1 * 2/2004 Haddon ..... 297/393

* cited by examiner

*Primary Examiner* — David Dunn
*Assistant Examiner* — Erika Garrett

(57) ABSTRACT

Disclosed is a portable head cradle for use by a seated user on an upwardly-facing top surface of a support that has a peripheral edge around the top surface. The portable head cradle includes a support structure configured to be placed on the top surface of the support and shaped and dimensioned for overlying engagement by a seated person's head. The support structure has a first substantially rigid portion and a second substantially rigid portion, the first substantially rigid portion and the second substantially rigid portion joined along at least one edge by a substantially flexible portion. A cradle portion is substantially inverted-U shaped when viewed by a user and dimensioned for engagement by the user at the forehead and cheeks of the user. At least one hook is extendable from the support structure and configured to engage the peripheral edge of the upwardly-facing top surface.

8 Claims, 7 Drawing Sheets

COLLAPSIBLE TABLETOP HEAD CRADLE FOR SEATED USERS

This application claims the benefit of Provisional Patent Application Ser. No. 61/059,215, filed on Jun. 5, 2008, to which priority is claimed pursuant to 35 U.S.C. §119(e) and which is hereby incorporated herein by reference.

FIELD OF THE INVENTION

The present invention relates, in general, to head cradles and, more particularly, to collapsible tabletop head cradles for seated users.

BACKGROUND OF THE INVENTION

Travelling can be an uncomfortable event in mass transportation systems designed for optimum passenger volume and not particularly with passenger comfort in mind. It is well recognized among regular passengers on commercial carriers that it is often difficult to relax in the seats provided. In particular, economy class seating on aircraft and buses typically provides closely-spaced forward-facing seats in rows separated by a very small space. These seats severely restrict the passenger's movement out of the sitting position, causing fatigue and discomfort during the journey.

A common feature of economy class seating is the fold-down tray table presented to the passenger by the back of the seat in front. Passengers have been known to seek relief from the discomfort of their seats by leaning forward and resting their heads on a conventional pillow placed on the tray table in front. This practice does not always give the passenger the relief sought, however, especially when the pillow is too small to fit conveniently on the tray table, or when the pillow is too soft to prevent the passenger from feeling the tray table through the pillow.

Although pillows on which the user may lean forward and rest the head are known in the art, the present invention is distinguishable from previous designs suggesting this application. Kertz, U.S. Pat. No. 4,287,621, for example, discloses a steering wheel attachment that provides a foam pad pillow on which drivers may rest the arms and head. Another design variation is disclosed in Sparks et al., U.S. Pat. No. 4,235,472, which is directed to a multi-purpose resting and storage device of modular construction that may also be placed in the lap of a sitting person to provide support for the chin. In yet another variation, Wagner, U.S. Pat. No. 2,877,472, is directed to a solid pillow, disclosing three flexibly-connected segments that fold together.

For reasons stated above, and for other reasons which will become apparent to those skilled in the art upon reading the present specification, there is a need for systems and methods that provide for ease of rest during travel. There is a particular need for a collapsible head cradle. The present invention fulfills these and other needs, and addresses deficiencies in known systems and techniques.

SUMMARY OF THE INVENTION

Disclosed is a portable head cradle for use by a seated user on an upwardly-facing top surface of a support that has a peripheral edge around the top surface. The portable head cradle includes a support structure configured to be placed on the top surface of the support and shaped and dimensioned for overlying engagement by a seated person's head. The support structure has a first substantially rigid portion and a second substantially rigid portion, the first substantially rigid portion and the second substantially rigid portion joined along at least one edge by a substantially flexible portion. A cradle portion is substantially inverted-U shaped when viewed by a user and dimensioned for engagement by the user at the forehead and cheeks of the user. At least one hook is extendable from the support structure and configured to engage the peripheral edge of the upwardly-facing top surface.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

BRIEF DESCRIPTION OF THE DRAWINGS

The novel features of the invention are set forth with particularity in the appended claims. The invention itself, however, both as to organization and methods of operation, together with further objects and advantages thereof, may best be understood by reference to the following description, taken in conjunction with the accompanying drawings in which:

In the following description of the illustrated embodiments, references are made to the accompanying drawings, which form a part hereof, and in which is shown by way of illustration various embodiments in which the invention may be practiced. It is to be understood that other embodiments may be utilized, and structural and functional changes may be made without departing from the scope of the present invention.

DETAILED DESCRIPTION OF THE INVENTION

The present invention relates, in general, to head cradles and, more particularly, to collapsible tabletop head cradles for seated users. The head cradle allows a seated person to lean forward and rest or sleep with their upper body in semi-prone position, for example, during air travel. The head cradle may attach to the edge of a table and uses a hook attachment to engage the bottom of tray table edge for stability and leverage, allowing a seated passenger to lean forward and rest face down with their head in the cradle. The assembled cradle and structure provides privacy and darkness to facilitate sleep. The cradle may also allow private viewing of small electronic devices. The head cradle may detach for secondary use as a neck bolster or pillow. Embodiments incorporate a lightweight folding design, which may be easily carried and packed into luggage.

Upper surfaces of the head cradle are approximately horizontal and may be slightly inclined or curved for comfort. Upper surfaces are padded on top with foam or fibrous material to provide comfortable interface with user's forehead. Lower surfaces may be padded for comfortable interface with user's shoulders in neck pillow mode. The head cradle's top surface that contacts the users head or face is configured in an inverted U-shape with the opening in the center to allow user's nose and mouth free passage and unrestricted airflow. The head cradle surface may be detachable from the supporting structure for alternative use as a neck pillow for upright sleeping while in a seated position. The head cradle affords the user a resting place which is straight in line with the user's spine, avoiding the familiar complaint of a "crick in the neck" from sleeping upright with head tilting to the side and uneven compression on neck vertebrae, with accompanying muscle compensation and discomfort. The head cradle also offers a refuge from unwanted attention and unwanted conversation from adjacent passengers.

Figure 1:
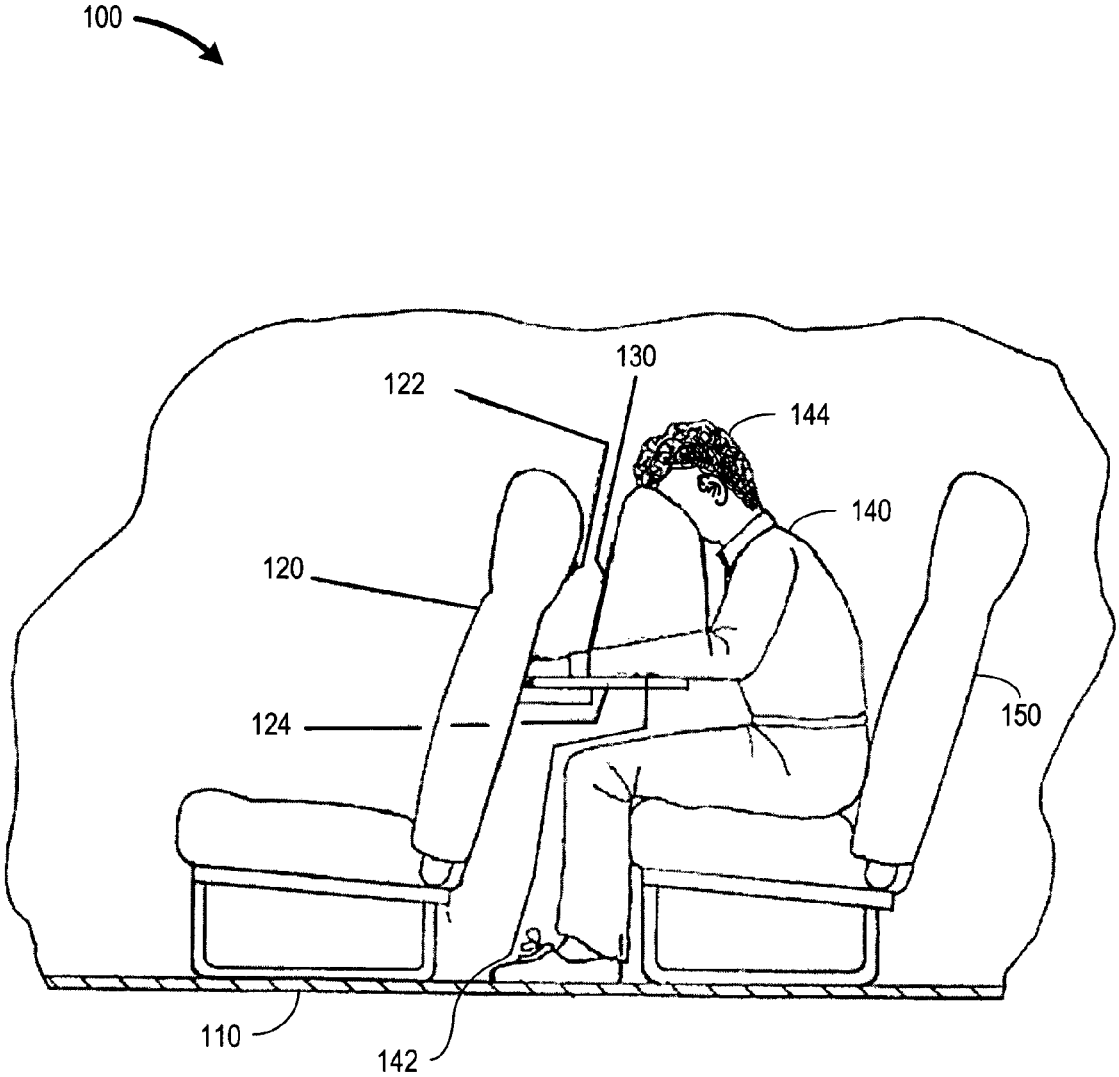
FIG. 1 is a cutaway view of a fuselage of an airplane illustrating a seated passenger using a head cradle in accordance with embodiments of the present invention.

FIG. 1 is a cutaway view of a fuselage 100 of an airplane illustrating a seated passenger 140 using a head cradle 130 in accordance with embodiments of the present invention. A floor 110 is illustrated supporting a first seat 120 and a second seat 150. The passenger 140 is illustrated seated in the second seat 150 of the fuselage 100. The passenger is illustrated as resting his arm 142 on a table 124 of the first seat 120. A head 144 of the passenger 140 is illustrated resting on the head cradle 130.

Figure 2:
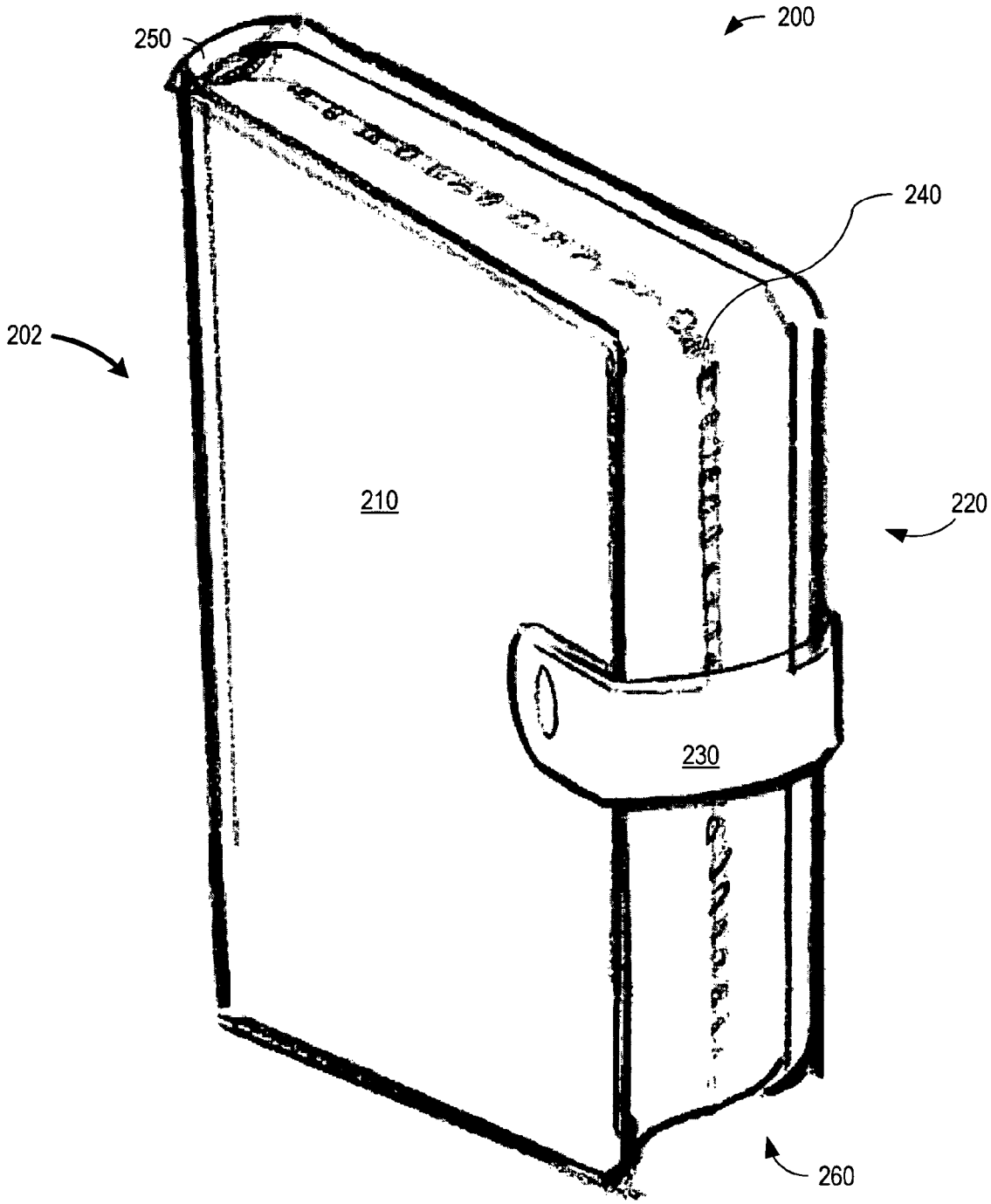
FIG. 2 is a perspective view of a collapsed head cradle in accordance with embodiments of the present invention.

FIG. 2 is a perspective view of a collapsed head cradle 200 in accordance with embodiments of the present invention. A support structure 202 includes a first substantially rigid section 210 and a second substantially rigid section 220 coupled by a substantially flexible section 250. The support structure 202 is illustrated in FIG. 2 collapsed into a book-shaped configuration. A substantially flexible casing 260 may be used to retain the head cradle 200 in its collapsed configuration using a zipper 240, a clasp 230, or both the zipper 240 and the clasp 230.

Figure 3:
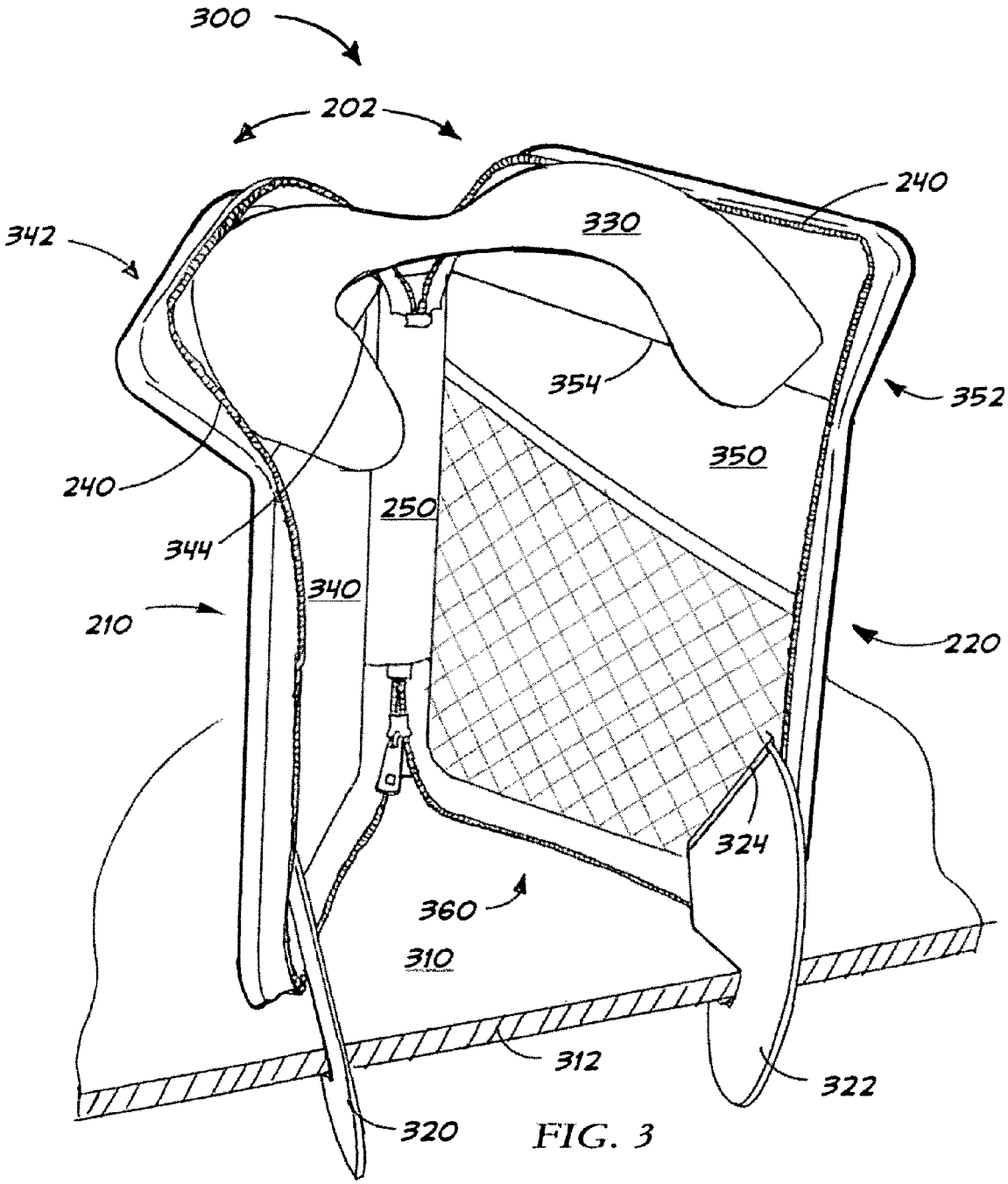
FIG. 3 is a perspective view of an open head cradle on a horizontal surface in accordance with embodiments of the present invention.

FIG. 3 is a perspective view of an open head cradle 300 on a horizontal surface 310 in accordance with embodiments of the present invention. In FIG. 3, the support structure 202 is illustrated in an open arrangement, with the open head cradle 300 positioned for use to support a user's head. A cradle portion 330 is illustrated attached to the support structure 202, and configured to comfortable cradle a user's head. The support structure 202 of the head cradle 300 supports the cradle portion 330 and the cradle portion 330 may attach to the support structure 202 using, for example, a zipper, snaps, hook and loop fasteners or other suitable attachment mechanisms. The support structure 202 may incorporate hinges, folds, or other structure to allow folding and storage, such as the flexible portion 250, for example. The support structure 202 may be used to shield the user from unwanted light stimulus and provide a privacy screen for the user. For instance, in a relaxed state the user may salivate, and the structure provides a measure of privacy from adjacent passengers.

In FIG. 3, the support structure 202 is illustrated with the first substantially rigid section 210 opened to reveal an inner surface 340 and an upper surface 342 connected by a bend 344. The second substantially rigid section 220 is illustrated opened to reveal an inner surface 350 and an upper surface 352 connected by a bend 354. The inner surface 350 is illustrated having a mesh pocket 360 that may be used, for example, to secure a passport, ipod, or other accessories during a flight or other travel by the user.

The support structure 202 may incorporate one or more hook mechanisms, such as a first hook 320 and a second hook 322 illustrated in FIG. 3 as engaging an edge 312 of a flat surface 310. The first hook 320 and the second hook 322 provide anchoring of the support structure 202 to the peripheral edge 312 of a table top, such as the flat surface 310 in front of the user, (or anchoring to upper surface of adjacent seatback in an alternate embodiment) for location, stability and leverage.

The first hook 320 and second hook 322 may be foldable, and extend out from the support structure 202 using a fold 324, which, for example, may be a hinge or sewn reinforced seam configured to be at about 45 degrees from the flat surface 310 when the head cradle 300 is in its open position. The first hook 320 and second hook 322 may engage the underside of the peripheral edge of the surface, so that the cradle is restricted from lifting off the flat surface 310.

Figure 4:
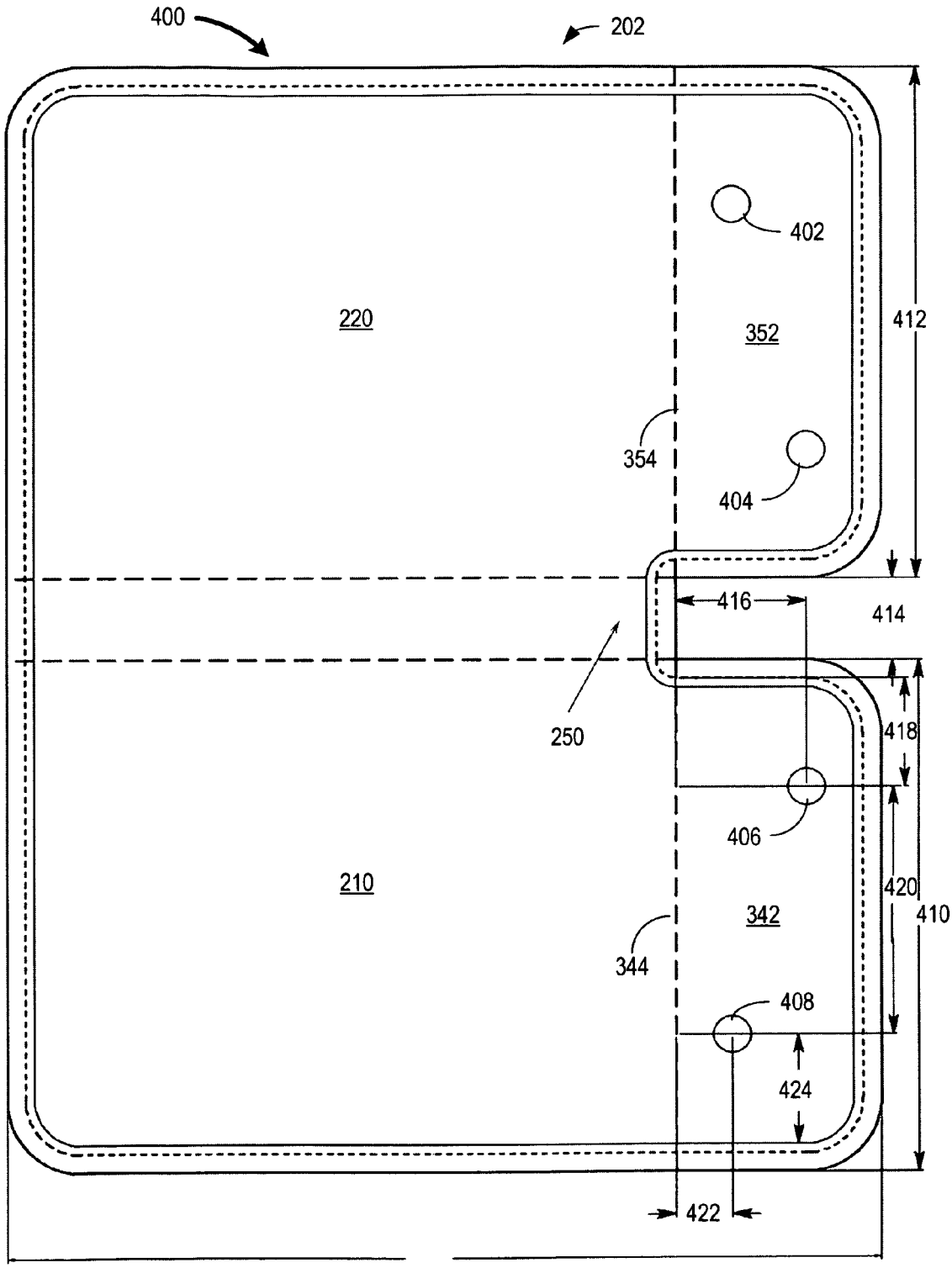
FIG. 4 is a plan view of the case of a head cradle in accordance with embodiments of the present invention.

FIG. 4 is a plan view of a case 400 of the head cradle 300 in accordance with embodiments of the present invention. The case 400 encompasses the support structure 202 including the first substantially rigid section 210, the second substantially rigid section 220, and the flexible portion 250, where the flexible portion 250 includes a recess 410 that provides for bending of the first substantially rigid section 210 at the bend 344 and the bending of second substantially rigid section 220 at the bend 354. Bending of the first substantially rigid section 210, the second substantially rigid section 220 provides for the upper surface 342 and the upper surface 352 to be substantially flat relative to the surface the head cradle 300 is resting upon. This provides for the cradle portion 330 to also be substantially flat relative to the surface the head cradle 300 is resting upon, thereby providing a comfortable resting position for the user.

In the embodiment illustrated in FIG. 4, the head cradle 300 has a height 430 of about 11.75 inches, a depth 410 and a depth 412 of about 7 inches, and a width 414 of about 1.125 inches. The recess 410 is illustrated as about 2.5 inches. The recess 410 provides for both an upper surface to attach the cradle portion 330 while also providing vertical support from the support structure 202 such that the first substantially rigid section 210 and the second substantially rigid section 220 do not spread so wide as to allow the user's head 144 (FIG. 1) to fall through to the flat surface 310 (FIG. 3.) In the embodiment illustrated in FIG. 4, a snap location 402, 404, 406, and 408 are illustrated as locations suitable for providing snaps that may be used to attach the cradle portion 330 (Illustrated in FIG. 3, for example,) to the support structure 202. The snap location positions may be determined by a dimension 422 of 0.75 inches, a dimension 424 of 1.5 inches, a dimension 420 of 3.375 inches, and a dimension 416 of 1.75 inches, for example. Dimensions are provided to indicate a suitable arrangement, and are not intended to limit the scope of the present invention.

Figure 5:
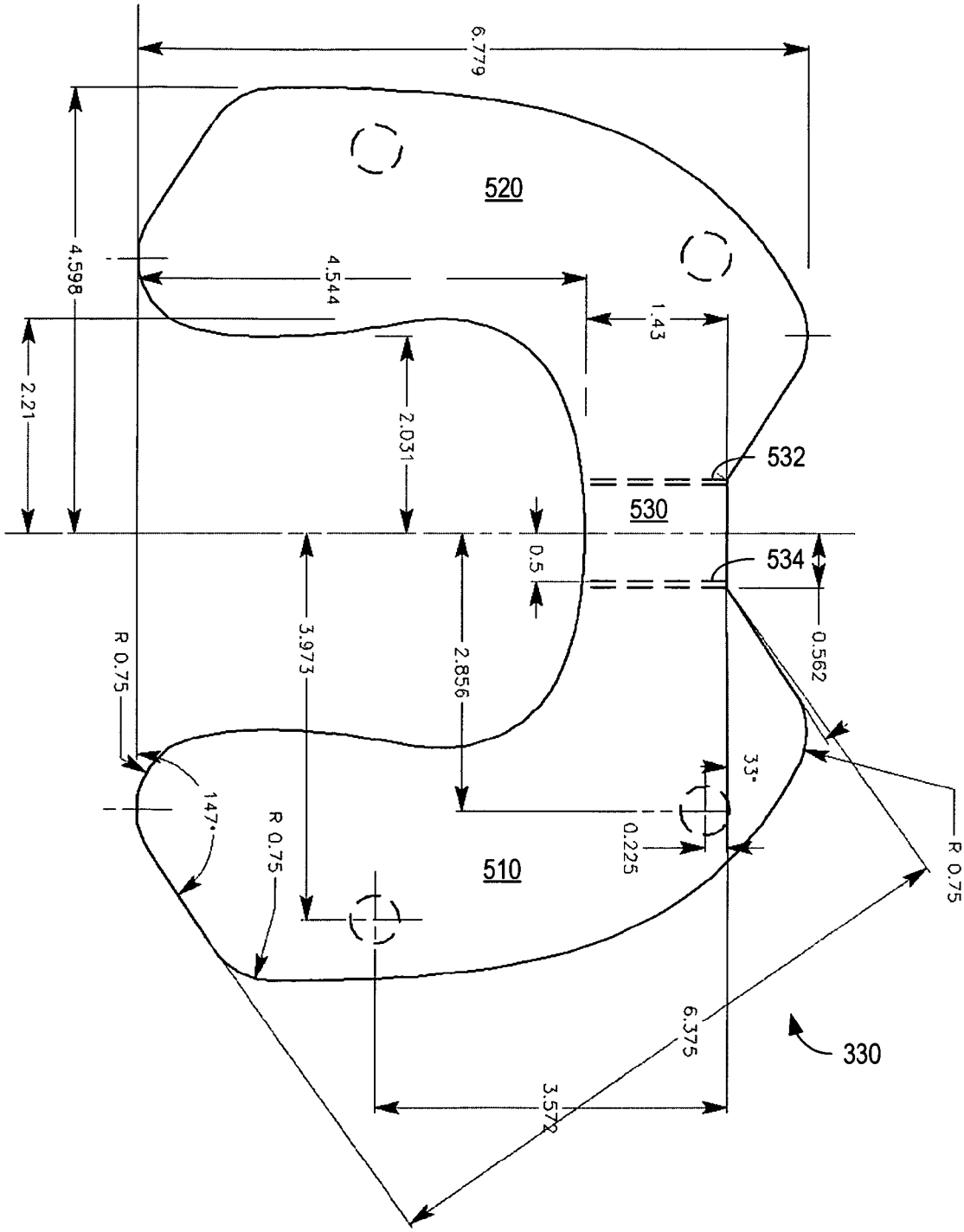
FIG. 5 is a plan view of the face support portion of a head cradle in accordance with embodiments of the present invention.

FIG. 5 is a plan view of the cradle portion 330 of head cradle 300 in accordance with embodiments of the present invention. In FIG. 5 the cradle portion 330 is illustrated as an engineering drawing having dimensions provided in inches, where the dimensions are examples of dimensions suitable for attaching the cradle portion 330 to the support structure 202 illustrated in FIG. 4. Again, dimensions are provided as suitable dimensions enabling the embodiment illustrated in FIGS. 4 and 5, but the dimensions are not intended to be limiting to the scope of the present invention. For example, any dimensions disclosed herein, including angles, may be increased or decreased within a range of about 30% or more without departing from the scope of the present invention. The cradle portion 330 may be manufactured from a rigid base plate made of a material suitable for supporting the head and face of a user, such as Aluminum, polyvinylchloride, polyethylene, epoxy carbon fiber composite, or other suitable material. The cradle portion 330 that the head rests upon may be manufactured from foam, gel, cloth, or other suitable cushioning material. For example, the cradle portion 330 may be 0.5 inches in total thickness, with a 0.125 inch thick polyethylene base adhered to a 0.325 inch foam padding. The cradle portion 330 in another embodiment may include an air bladder and an inflation port that provides for inflating the air bladder, thereby providing an air cushion in addition to, or as a replacement for, the foam or other cushioning material.

In FIG. 5, the cradle portion 330 is illustrated to include a first cradle portion 510 and a second cradle portion 520 connected by a bottom of the U portion 530. A fold location 534 is illustrated connecting the first cradle portion 510 to the bottom of the U portion 530 and a fold location 532 is illustrated connecting the second cradle portion 520 to the bottom of the U portion 530. The fold location 532 and fold location 534 provide for folding the cradle portion 330 into a size suitable for insertion into the support structure 202 when the support structure 202 is collapsed.

Figure 6:
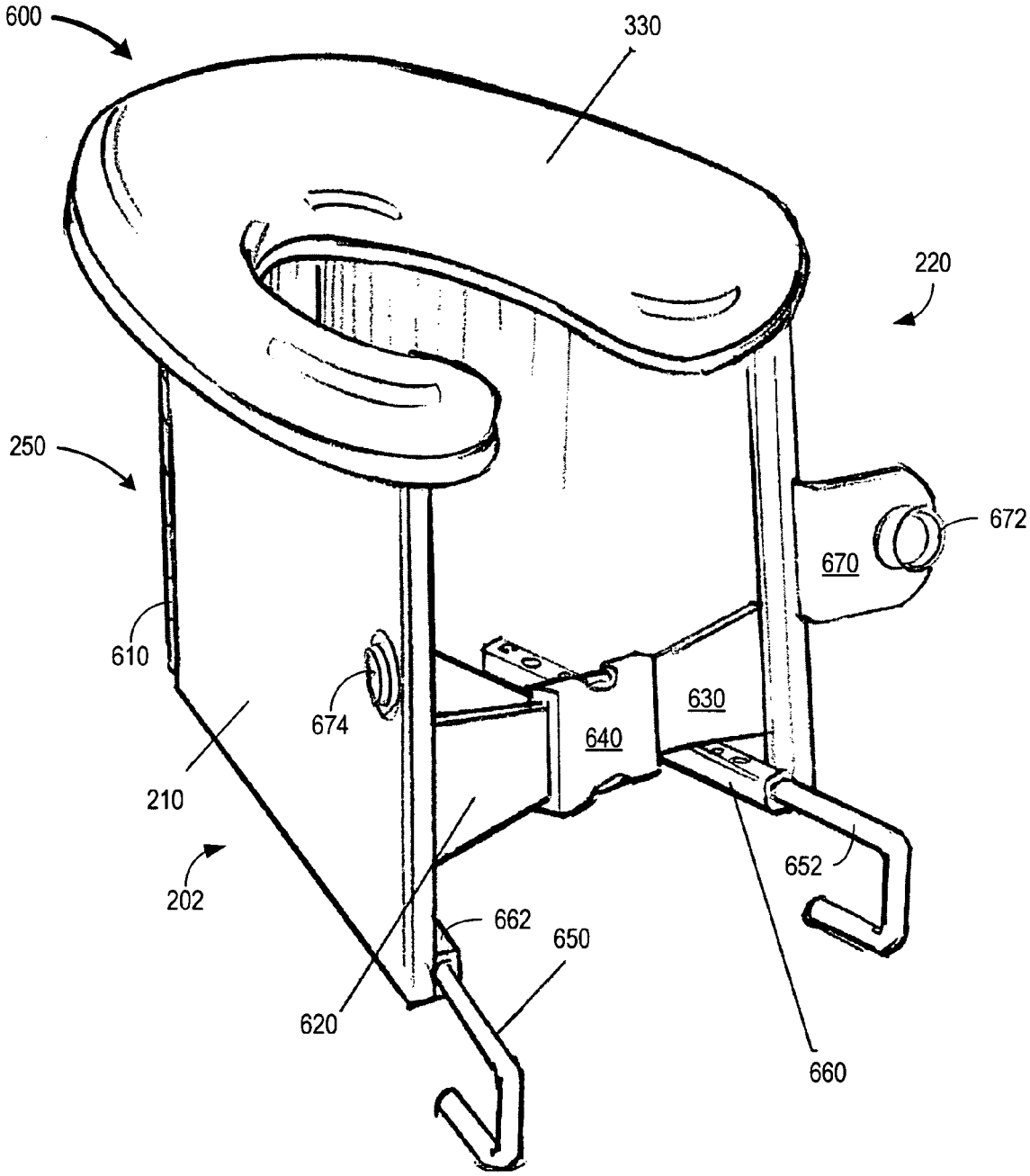
FIG. 6 is a plan view of a clasped head cradle in accordance with embodiments of the present invention.

FIG. 6 is a plan view of a clasped head cradle 600 in accordance with further embodiments of the present invention. The cradle portion 330 is illustrated in an inverted U shape to provide a comfortable surface for the users head 144 (FIG. 1.) In the embodiment illustrated in FIG. 6, the flexible portion 250 is implemented using a hinge 610. A flap 670 provides support for a female snap 672, which is configured to engage a male snap 674 when the head cradle 600 is in its collapsed configuration. A left strap 620 and a right strap 630 are illustrated as joined together by a buckle 640 to keep the first substantially rigid section 210 and the second substantially rigid section 220 from separating too far.

In the embodiment illustrated in FIG. 6, a hook 650 and a hook 652 are respectively coupled to the first substantially rigid section 210 and the second substantially rigid section 220 using mounting hardware 662 and 660. Hooks 650, 652 may be retractably inserted into the mounting hardware 660, 662 and rotatable, so as to stow inside the collapsed head cradle 600. The hooks 650, 652 may be adjustably extendable for positioning using ball detents, spring loaded snaps, or other suitable adjustment mechanisms.

The support structure 202 may incorporate fasteners such as, for example, plastic bayonet fasteners, zipper or snaps to create structural integrity between adjacent folding panels of support structure such as the first substantially rigid section 210 and the second substantially rigid section 220. The support structure 202 may fold and may have closures to encapsulate the head cradle 330 for storage and portability.

Figure 7:
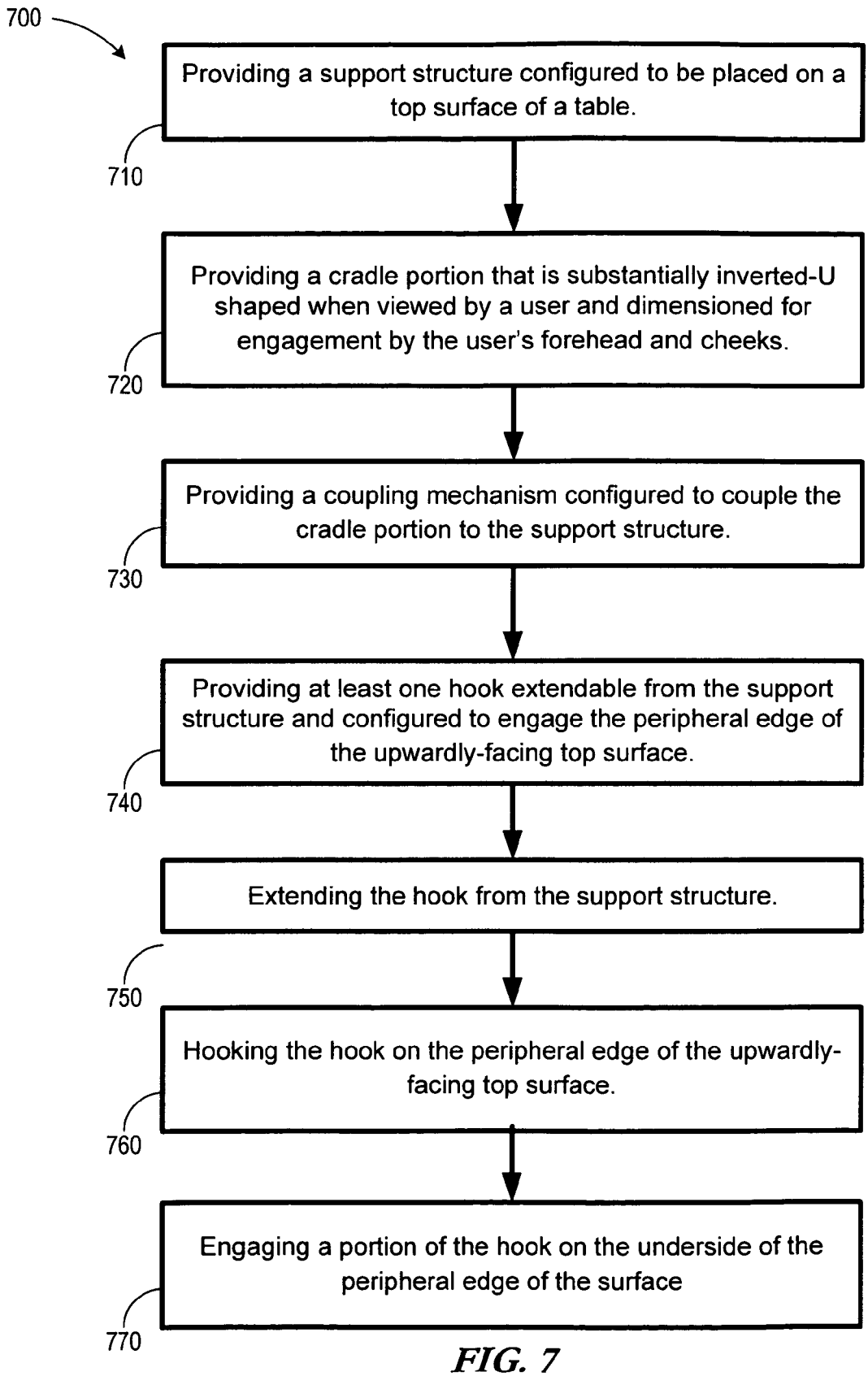
FIG. 7 is a flow chart of a method of cradling a head in accordance with embodiments of the present invention.

FIG. 7 is a flow chart of a method 700 of cradling a head in accordance with embodiments of the present invention. Method 700 involves a method of cradling a user's head. The method 700 involves providing a support structure configured to be placed on a top surface of a table 710, the table having a peripheral edge. The support structure is shaped and dimensioned for overlying engagement by a seated person's head, and includes a first substantially rigid portion and a second substantially rigid portion. The first substantially rigid portion and a second substantially rigid portion are joined along at least one edge by a substantially flexible portion. A cradle portion is provided that is substantially inverted-U shaped when viewed by a user and dimensioned for engagement by the user at the forehead and cheeks 720 of the user, wherein the bottom of the U is adjacent the substantially flexible portion of the support structure. The method 700 further involves providing a coupling mechanism configured to couple the cradle portion to the support structure 730 and providing at least one hook extendable from the support structure and configure to engage the peripheral edge of the upwardly-facing top surface 740. The hook may be extended from the support structure 750 and hook on the peripheral edge of the upwardly-facing top surface 760. A portion of the hook may engage 770 the underside of the peripheral edge of the surface (for example, the bottom of the upwardly-facing top surface 760,) so that the cradle is restricted from lifting off the flat surface.

The support structure may employ, for example, clasps or fasteners to create a triangular prism or similar polyhedral vertical prism as an integral support for the upper surfaces of the head cradle. In one embodiment, a user may extend one or more retractable hooks from bottom of support structure and engage the hooks under an edge of a table immediately in front of him or her. In an alternate embodiment, hooks and straps may extend under tabletop to engage back edge of table. In still a further embodiment, hooks may be folded out from an inner portion of the support structure to control undesired movement of the head cradle on the surface of a table or other horizontal surface. The user is then able to lean forward and rest his or her head on the device without having the device sliding further away from the user or tipping over.

In the secondary use, the user detaches the cradle portion of the device and uses it as a neck bolster pillow. In the folded mode, the hooks may be retracted within the confines of the structure or folded up into the structure and the cradle may be stored inside the structure, which may also be foldable for ease of carrying, shipping, merchandising and storage. Different locations of hooks may allow device to be used in trains or buses where tables are not present, by allowing attachment to seat back in front of user. Alternative designs may allow folding structure to be collapsed in different directions or rolled up.

The device head cradle 600 may be constructed of temporary or disposable or recyclable materials, as might be intended for single use. Such materials might include but not limited to, polymer or styrene foams, paper, corrugated paper or cardboard. Such a construction would allow single use and disposal after use by a traveler upon reaching his or her destination.

Head cradle 600 may also be used in trains or buses where a table is not present between seats.

Methods and devices employing head cradles in accordance with the present invention may incorporate one or more of the features, structures, methods, or combinations thereof described herein below. For example, head cradles may be implemented to include one or more of the features and/or processes described below. It is intended that such a device or method need not include all of the features and functions described herein, but may be implemented to include one or more features and functions that, alone or in combination, provide for unique structures and/or functionality.

It is understood that the components and functionality depicted as separate or discrete blocks/elements in the figures may be implemented in combination with other components and functionality, and that the depiction of such components and functionality in individual or integral form is for purposes of clarity of explanation, and not of limitation.

Illustrations of method steps, such as, for example, the steps illustrated in FIG. 7, show steps sequentially and in a particular order. There is no need to perform the steps in the order illustrated. Deviating from the illustrated order for some or all of the steps is contemplated by the inventor, and does not depart from the scope of the present invention.

Each feature disclosed in this specification (including any accompanying claims, abstract, and drawings), may be replaced by alternative features having the same, equivalent or similar purpose, unless expressly stated otherwise. Thus, unless expressly stated otherwise, each feature disclosed is one example only of a generic series of equivalent or similar features.

While preferred embodiments of the present invention have been shown and described herein, it will be obvious to those skilled in the art that such embodiments are provided by way of example only. Numerous variations, changes, and substitutions will be apparent to those skilled in the art without departing from the invention. Accordingly, it is intended that the invention be limited only by the scope of the appended claims.

What is claimed is:

1. A portable head cradle for use by a seated user, on an upwardly-facing top surface of a support that has a peripheral edge around the top surface, the portable head cradle comprising:

a support structure configured to be placed on the top surface of the support and shaped and dimensioned for overlying engagement by the seated user's head, the support structure comprising a first substantially rigid portion and a second substantially rigid portion, the first substantially rigid portion and the second substantially rigid portion joined along at least one edge by a substantially flexible portion;

a cradle portion substantially inverted-U shaped when viewed by the user and dimensioned for engagement by the user at the forehead and cheeks of the user, wherein the bottom of the U is adjacent the substantially flexible portion of the support structure;

a coupling mechanism configured to couple the cradle portion to the support structure; and at least one hook extendable from the support structure and configure to engage the peripheral edge of the upwardly-facing top surface.

2. The device of claim 1, wherein the at least one hook is extendable from the support structure by folding out from an inner surface of the support structure.

3. The device of claim 1, wherein the at least one hook is extendable from the support structure by rotating and extending out from a mounting, the mounting coupled to an inner surface of the support structure.

4. The device of claim 1, wherein the cradle portion comprises two substantially rigid portions coupled by a substantially flexible portion, the substantially flexible portion located adjacent the bottom of the U, whereby the cradle portion is foldable such that the outer circumference of the collapsed cradle portion is dimensioned to fit inside the collapsed support structure.

5. The device of claim 1, wherein the first substantially rigid portion and the second substantially rigid portion each have a height and a width, wherein the height is divided into a vertical portion and a horizontal portion, the vertical portion and the horizontal portion separated by a substantially flexible joint, wherein the vertical portion is dimensioned to be about the height of the substantially flexible portion of the support structure, and the horizontal portion of the height of the first and second substantially rigid portions are dimensioned to be about the depth of a recess of the substantially flexible portion of the support structure.

6. A method of cradling a user's head, the method comprising;

providing a collapsible support structure configured to be placed on a top surface of a table, the table having a peripheral edge, the support structure shaped and dimensioned for overlying engagement by a seated person's head, the support structure comprising a first substantially rigid portion and a second substantially rigid portion, the first substantially rigid portion and a second substantially rigid portion joined along at least one edge by a substantially flexible portion;

providing a cradle portion that is substantially inverted-U shaped when viewed by a user and dimensioned for engagement by the user at the forehead and cheeks of the user, wherein the bottom of the U is adjacent the substantially flexible portion of the support structure;

providing a coupling mechanism configured to couple the cradle portion to the support structure;

providing at least one hook extendable from the support structure and configured to engage the peripheral edge of the upwardly-facing top surface;

extending the hook from the support structure; and hooking the hook on the peripheral edge of the upwardly-facing top surface.

7. The method of claim 6, further comprising:

supporting the user's forehead and cheeks using the cradle portion.

8. A device for cradling a user's head, comprising;

supporting means for supporting a users head, the supporting means configured to be placed on a top surface of a table, the table having a peripheral edge, the supporting means shaped and dimensioned for overlying engagement by a seated person's head, the support means comprising a first substantially rigid portion and a second substantially rigid portion, the first substantially rigid portion and a second substantially rigid portion joined along at least one edge by a substantially flexible portion;

cradling means for cradling the user's head, the cradling means configured in a substantially inverted-U shape when viewed by the user and dimensioned for engagement by the user at the forehead and cheeks of the user, wherein the bottom of the U is adjacent the substantially flexible portion of the support structure;

coupling means for coupling the cradling means to the support means;

hook means for hooking the peripheral edge of the upwardly-facing top surface; and extending means for extending the hook means from the support means.

* * * * *